US010431937B1

(12) United States Patent
Wang et al.

(10) Patent No.: US 10,431,937 B1
(45) Date of Patent: Oct. 1, 2019

(54) ELECTRIC CONNECTOR FOR ELECTRONIC DEVICE

(71) Applicant: Acer Incorporated, New Taipei (TW)

(72) Inventors: Yu-Shih Wang, New Taipei (TW); Pao-Min Huang, New Taipei (TW); Yan-Fong Cheng, New Taipei (TW); Yi-Ta Huang, New Taipei (TW); Wu-Chen Lee, New Taipei (TW); Cheng-Nan Ling, New Taipei (TW); Wen-Neng Liao, New Taipei (TW)

(73) Assignee: Acer Incorporated, New Taipei (TW)

( * ) Notice: Subject to any disclaimer, the term of this patent is extended or adjusted under 35 U.S.C. 154(b) by 0 days.

(21) Appl. No.: 16/136,290

(22) Filed: Sep. 20, 2018

(30) Foreign Application Priority Data

May 11, 2018 (TW) ..... 107116096 A

(51) Int. Cl.

| | |
|---|---|
| ***H01R 13/50*** | (2006.01) |
| ***H01R 13/6591*** | (2011.01) |
| ***H01R 13/6581*** | (2011.01) |
| *H01R 4/02* | (2006.01) |
| *H01R 13/58* | (2006.01) |
| *H01R 13/56* | (2006.01) |

(52) U.S. Cl.
CPC ..... *H01R 13/6591* (2013.01); *H01R 13/50* (2013.01); *H01R 13/6581* (2013.01); *H01R 4/023* (2013.01); *H01R 13/567* (2013.01); *H01R 13/5841* (2013.01); *Y10S 439/902* (2013.01)

(58) Field of Classification Search
CPC ..... H01R 13/567; H01R 13/5841; Y10S 439/902
See application file for complete search history.

(56) References Cited

U.S. PATENT DOCUMENTS 5,234,358 A * 8/1993 Polgar ..... H01R 13/506 439/465
6,155,884 A * 12/2000 Sugiyama ..... H01R 13/516 439/701
6,830,488 B2 * 12/2004 Bush ..... H01R 13/6463 439/676

* cited by examiner

*Primary Examiner* — Tho D Ta
(74) *Attorney, Agent, or Firm* — JCIPRNET

(57) ABSTRACT

An electric connector suited for an electronic device is provided. The electric connector includes a body, a plurality of terminals, and an electrical connecting member. The body is suited to be disposed in the electronic device and has at least one receiving area located on at least one of a top portion and a bottom portion of an exterior of the body. The terminals are disposed in the body, and an external electric connector is suited to be butted to the body along a first axis to be electrically connected to the terminals. One end of the electrical connecting member is located at the receiving area to be electrically connected to the terminals, and another end of the electrical connecting member extends out of the receiving area along a second axis to be electrically connected to the electronic device. The first axis is different from the second axis.

8 Claims, 4 Drawing Sheets

ELECTRIC CONNECTOR FOR ELECTRONIC DEVICE

CROSS-REFERENCE TO RELATED APPLICATION

This application claims the priority benefit of Taiwan application serial no. 107116096, filed on May 11, 2018. The entirety of the above-mentioned patent application is hereby incorporated by reference herein and made a part of this specification.

BACKGROUND

Technical Field

The invention relates to an electric connector.

Description of Related Art

Electric connectors are connecting devices for being connected to electrical wires, circuit boards, and other electronic components through electrical transmission and are widely applied to a variety of electronic devices, such as computers, notebook computers, mobile phones, etc. General connectors are designed according to the various specifications and regulations of circuit lines, and one connector can only be connected to one line of a specific type. Various types of transmission lines are required to be included in one single electronic device so as to satisfy the demand for multifunction of the electronic products, and thus, multiple electric connectors are disposed in one electronic device most of the time.

Nevertheless, during the manufacturing process of an electronic device, the electric connectors are required to be individually soldered to a circuit board, and that much time is required when manufacturing the electronic product. More importantly, as the electronic devices are designed to be thin and lightweight, insufficient space for the connectors to be disposed in the electronic device may be provided, and therefore, how to overcome such problem is an important issue in this field for those having ordinary skill in the art.

SUMMARY

The invention provides an electric connector in which a wiring manner required by an electrical connecting member is changed, and that a space occupied by the electric connector in the electronic device is reduced.

In an embodiment of the invention, an electric connector suited for an electronic device is provided. The electric connector includes a body, a plurality of terminals, and an electrical connecting member. The body is suited to be disposed in the electronic device, and the body has at least one receiving area located on at least one of a top portion and a bottom portion of an exterior of the body. The terminals are disposed in the body, and an external electric connector is suited to be butted to the body along a first axis to be electrically connected to the terminals. One end of the electrical connecting member is located at the receiving area to be electrically connected to the terminals, and another end of the electrical connecting member extends out of the receiving area along a second axis to be electrically connected to the electronic device, wherein the first axis is different from the second axis.

To sum up, in the electric connector, the receiving area is disposed on at least one of the top portion and the bottom portion of the exterior of the body. When the electrical connecting member is electrically connected between the electronic device and the terminals of the electric connector, one end of the electrical connecting member is located in the receiving area and is electrically connected to the terminals, and another end of the electrical connecting member extends out of the receiving area along the second axis. An external electric connector is butted to the body of the electric connector along the first axis, and the first axis is different from the second axis. In this way, a wiring direction of the electrical connecting member on the body of the electric connector is changed, and that the dimension of the electric connector along the first axis is effectively reduced. The space occupied by the electric connector in the electronic device is reduced, and therefore, applications of the electric connector are further expanded.

To make the aforementioned more comprehensible, several embodiments accompanied with drawings are described in detail as follows.

BRIEF DESCRIPTION OF THE DRAWINGS

The accompanying drawings are included to provide a further understanding of the disclosure, and are incorporated in and constitute a part of this specification. The drawings illustrate exemplary embodiments of the disclosure and, together with the description, serve to explain the principles of the disclosure.

DESCRIPTION OF THE EMBODIMENTS

Figure 1:
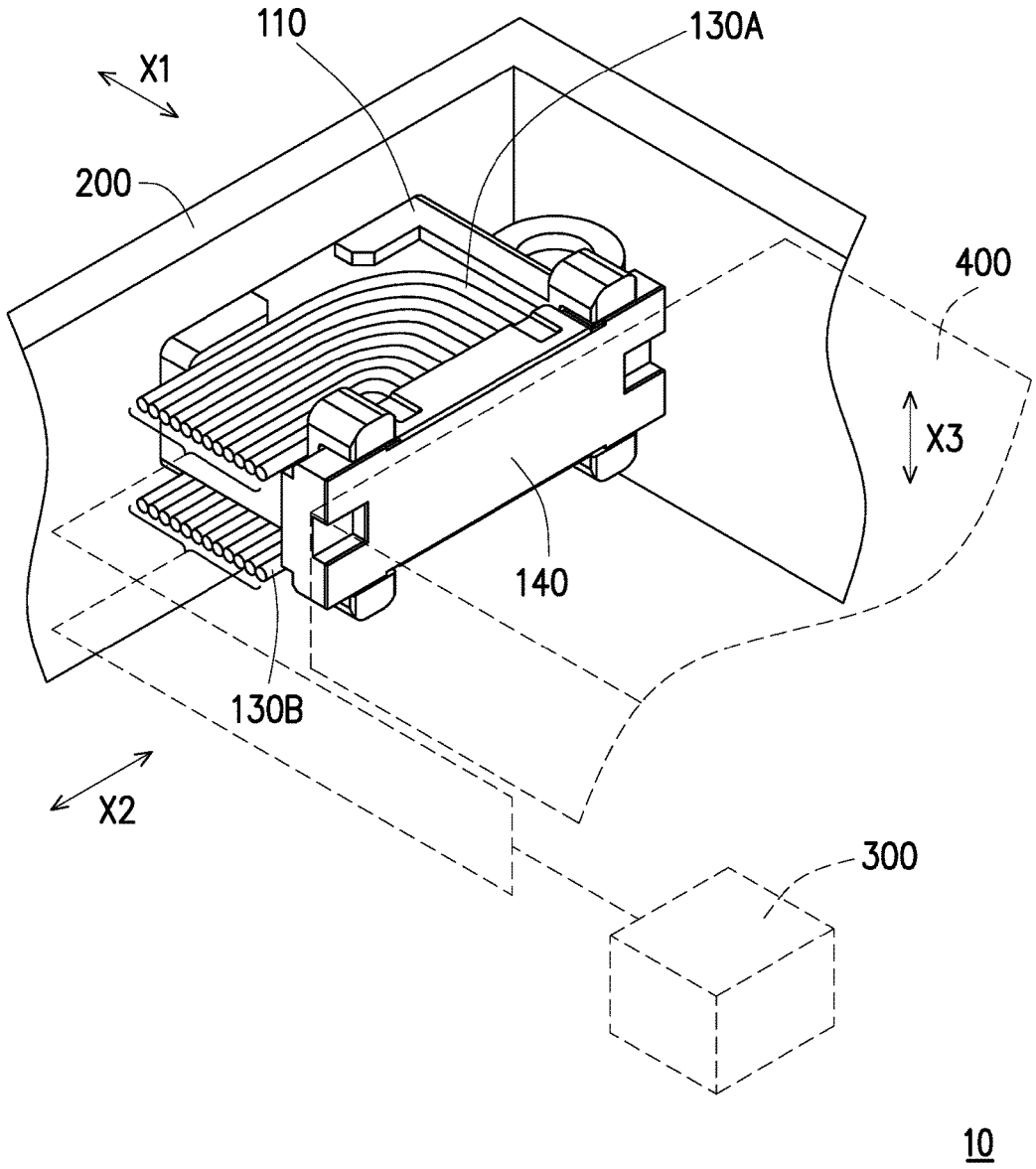
FIG. 1 and FIG. 2 are schematic views of an electric connector according to an embodiment of the invention.
Figure 2:
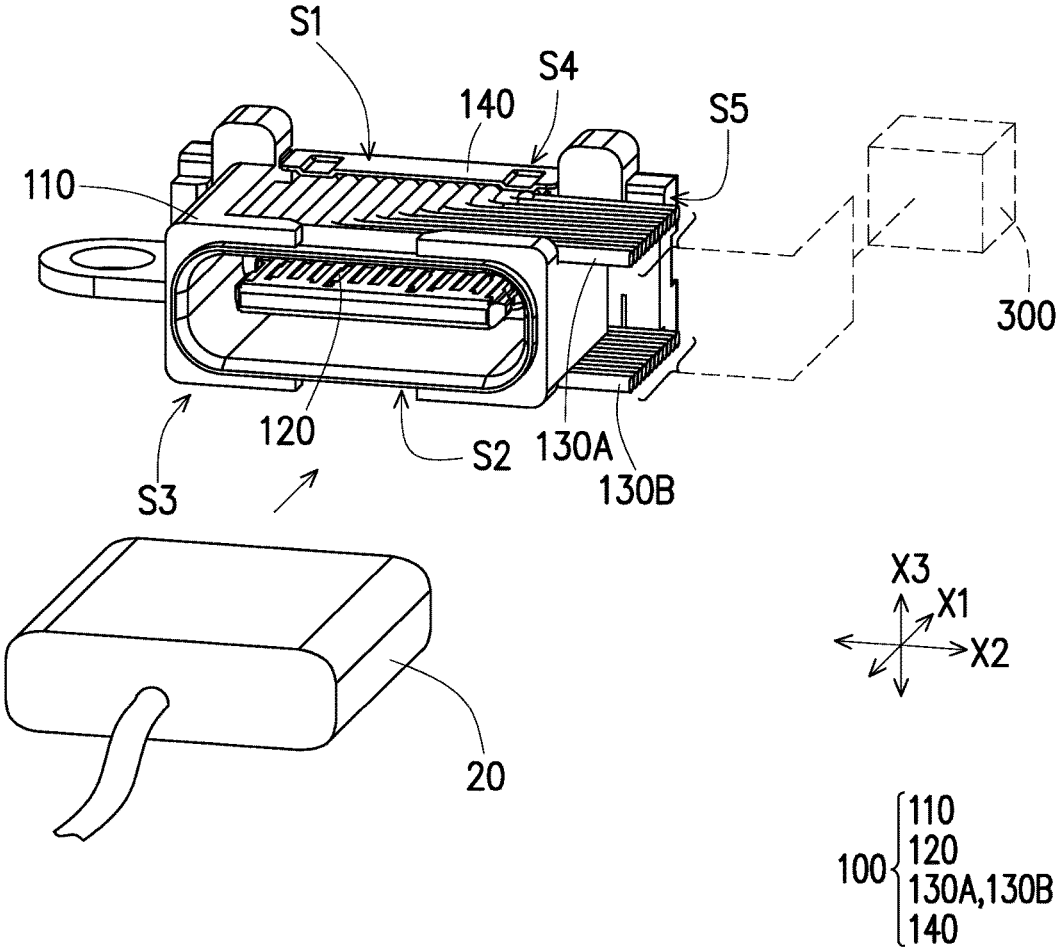
Figure 3:
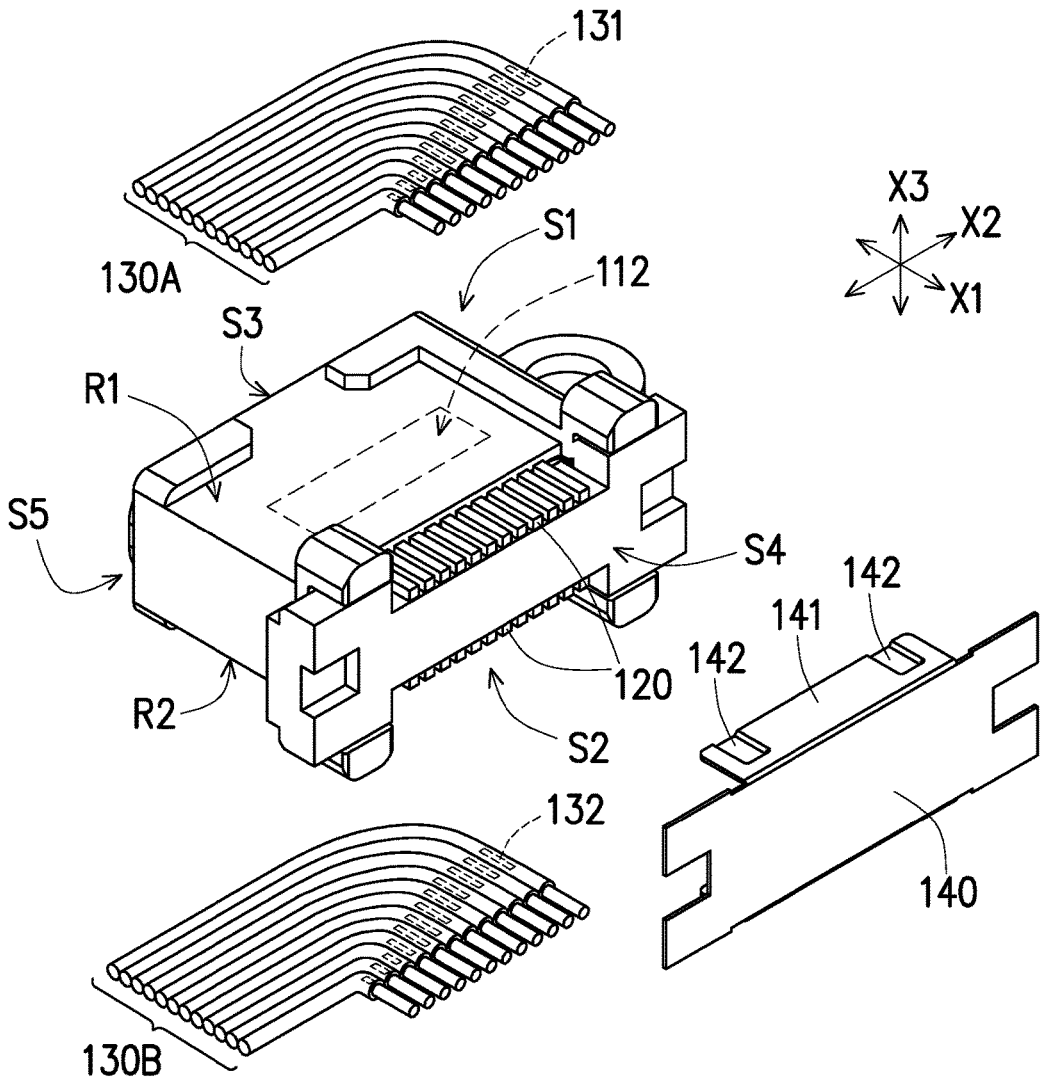
FIG. 3 is an exploded view illustrating part of components of the electric connector.

FIG. 1 and FIG. 2 are schematic views of an electric connector according to an embodiment of the invention, and the electric connector is illustrated from different perspective views. FIG. 3 is an exploded view illustrating part of components of the electric connector. With reference to FIG. 1 to FIG. 3, an electric connector 100 of this embodiment is suited for an electronic device 10. Herein, the electronic device 10 is exemplified as a notebook computer, but is not limited thereto. The electric connector 100 is, for example, a socket electric connector disposed in the electronic device 10. The electric connector 100 includes a body 110, a plurality of terminals 120, an electrical connecting member 130A, and an electrical connecting member 130B. The body 110 is suited to be disposed in a casing 200 of the electronic device 10 and partially exposed from the casing 200, and the terminals 120 are disposed in the body 110. The electrical connecting member 130A and the electrical connecting member 130B are, for example, electrical wires, coaxial cables, or flexible printed circuits (FPCs) and are electrically connected between the terminals 120 and a control module 300 (e.g., a mainboard of a notebook computer) of the electronic device 10. An external electric connector 20 is suited to be butted to the body 110 and is electrically conducted to the electronic device 10 through the terminals 120, the electrical connecting member 130A, and the electrical connecting member 130B.

Further, the body 110 has at least one receiving area located on at least one of a top portion and a bottom portion of an exterior of the body 110. In this embodiment, a top portion S1 and a bottom portion S2 of the exterior of the body 110 are exemplified as having a receiving area R1 and a receiving area R2, respectively. Nevertheless, how the receiving areas are disposed is not limited. In the embodiments that are not shown, the receiving areas may also be disposed only at the top portion of the body or only at the bottom portion of the body. In this embodiment, the receiving area R1 located at the top portion S1 may be regarded as being located directly above the terminals 120, and the receiving area R2 located at the bottom portion S2 may be regarded as being located directly below the terminals 120. In this way, the terminals 120 located in the body 110 are substantially located between the receiving area R1 and the receiving area R2.

Further, a pair of electrical connecting members 130A and 130B corresponding to the receiving areas R1 and R2 are illustrated in this embodiment. The electrical connecting member 130A is taken as an example herein. One end of the electrical connecting member 130A is located in the receiving area R1, and another end of the electrical connecting member 130A extends out of the receiving area R1 and extends to and is electrically connected to the control module 300 of the electronic device 10. As such, the terminals 120 are electrically conducted to the control module 300 through the electrical connecting member 130A and the electrical connecting member 130B. Similarly, one single electrical connecting member may correspond to one single receiving area as well in the embodiments that are not shown.

Note that for the electric connector 100, the external electric connector 20 is butted to the body 110 along a first axis X1 to be electrically connected to the terminals 120. In order to effectively change an external dimension of the electric connector 100 to fit into an internal space of the casing 200 of the electronic device 10, one end of the electrical connecting member 130A and one end of the electrical connecting member 130B of this embodiment are respectively disposed in the receiving area R1 and the receiving area R2 and are soldered to the terminals 120. Moreover, another end of the electrical connecting member 130A and another end of the electrical connecting member 130B are respectively extend out of the receiving area R1 and the receiving area R2 along a second axis X2, wherein the first axis X1 is different from the second axis X2. In other words, a wiring manner provided by the prior art to be performed to the electric connector 100 is changed by the electrical connecting member 130A and the electrical connecting member 130B of this embodiment. That is, the receiving area R1 and the receiving area R2 are adopted instead to act as areas in which electrical connecting members 130A and 130B and the terminals 120 are electrically connected to (soldered to) each other, and the electrical connecting members 130A and 130B are also changed to extend out of the receiving area R1 and the receiving area R2 from a lateral side S5 of the body 110. In this way, a length of the electric connector 100 along the first axis X1 may be effectively reduced.

Further, the body 110 has a front side S3 and a rear side S4 opposite to each other. The external electric connector 20 is inserted into the body 110 from the front side S3 along the first axis X1. That is, the front side S3, the receiving area R1, the receiving area R2, and the rear side S4 are arranged and disposed along the first axis X1. Unlike the front side S3, the receiving area R1, the receiving area R2, and the rear side S4, the lateral side S5 is not arranged and disposed along the first axis X1 and is located at the second axis X2 instead. In this embodiment, the first axis X1 is substantially orthogonal to the second axis X2.

Further, the electric connector 100 further includes a shielding member 140 assembled to the rear side S4 of the body 110. A material of the shielding member 140 is, for example, metal. The shielding member 140 is thus configured for shielding electromagnetic noise which may be generated by the terminals 120, the electrical connecting member 130A, or the electrical connecting member 130B. With reference to FIG. 1 again, in this embodiment, the electronic device 10 further includes an input module 400, for example, a keyboard. The input module 400 is disposed at the casing 200 and is partially located at the rear side S4 of the body 110 and is adjacent to the shielding member 140. In other words, in terms of a component layout in the electronic device 10, the input module 400 evidently occupies a space of the rear side S4 of the electric connector 100. Hence, if the electrical connecting member 130A and the electrical connecting member 130B are to be disposed at the rear side S4 through an existing technique, the electrical connecting member 130A and the electrical connecting member 130B are to be interfere with the input module 400. Inevitably, the electrical connecting member 130A and the electrical connecting member 130B have to be misaligned along a third axis X3 (corresponding to a thickness direction of the casing 200, that is, the first axis X1, the second axis X2, and the third axis X3 are substantially orthogonal to one another), so as to allow the electric connector 100 and the input module 400 to be disposed in the casing 200 together. In this case, a thickness of the casing 200 is required to be increased significantly, which is disadvantageous for satisfying the trend of thin and lightweight design. Accordingly, in this embodiment, the electrical connecting member 130A and the electrical connecting member 130B are changed to be soldered to the terminals 120 at the receiving area R1 and the receiving area R2. The electrical connecting member 130A and the electrical connecting member 130B then extend through the lateral side S5 of the body 110 and thus bypass the input module 400 to be electrically connected to the control module 300. In this way, the thickness (dimension along the third axis X3) of the casing 200 is less likely to be increased, and that a thin and lightweight appearance of the casing 200 is maintained.

Since the electric connector 100 and the input module 400 are correspondingly disposed, the shielding member 140 is disposed in the rear of the rear side S4 of the body 110 and can be shielded between the input module 400 and the electrical connecting member 130A and the electrical connecting member 130B (and the terminals 120). In this way, the terminals 120, the electrical connecting member 130A, and the electrical connecting member 130B are located at the same side of the shielding member 140.

Figure 4:
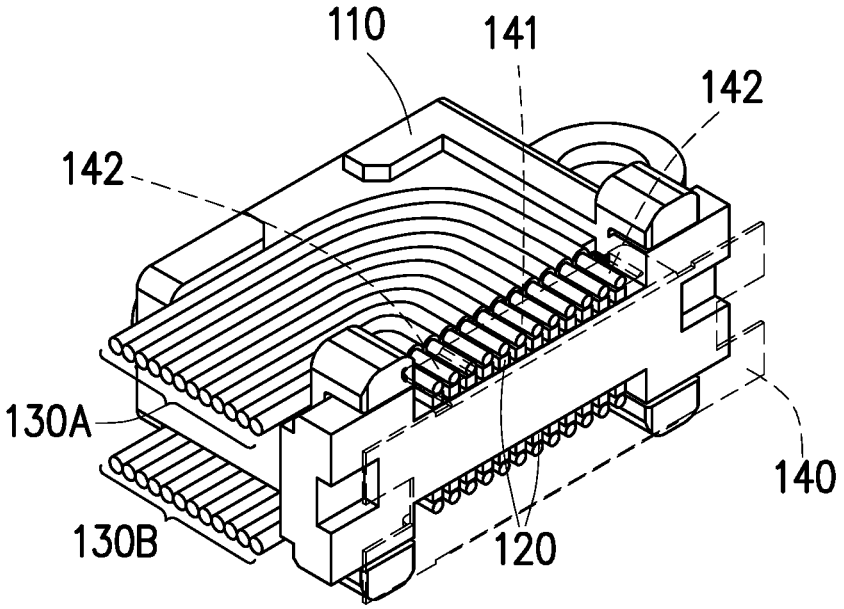
FIG. 4 is a schematic view of part of the components of the electric connectors.

In addition, FIG. 4 is a schematic view of part of the components of the electric connectors. The shielding member 140 is illustrated in dotted lines so as to visually identify the corresponding relationships between the shielding member 140, the electrical connecting member 130A, and the electrical connecting member 130B. With reference to FIG. 3 and FIG. 4 together, a portion of the shielding member 140 extends from the rear side S4 to the top portion S1 or the bottom portion S2, so as to be electrically connected to at least one grounding portion of the electrical connecting member 130A and at least one grounding portion of the electrical connecting member 130B. Further, in this embodiment, the shielding member 140 has a local portion 141 extending to the top portion S1. Moreover, a punched-up protrusion 142 is formed on the local portion 141, and the punched-up protrusion 142 is electrically propped against the at least one grounding portion of the electrical connecting member 130A. That is, the punched-up protrusion 142 is electrically connected to a ground wire, and that the electrical connecting member 130A is also grounded. Similarly, it thus can be seen that the shielding member 140 may also be equipped with another local portion extending to the bottom portion S2 and be electrically connected to a grounding wire of the electrical connecting member 130B through a punched-up protrusion being structurally disposed, so as to achieve the same grounding effect.

Further, with reference to FIG. 4 again, the terminals 120 of this embodiment (merely portions of the terminals 120 exposed out of the body 110 are illustrated as an example) are arranged along the second axis X2 and extend along the first axis X1. The electrical connecting member 130A (same as the electrical connecting member 130B and a relevant description thereof is thus omitted) is further divided into a first segment C1 and a second segment C2. The first segment C1 extends along the first axis X1 to be electrically connected to the terminals 120, and the second segment C2 extends along the second axis X2 from the first segment C1 to move out of the receiving area R1.

Besides, a material of an outer surface of the body 110 is metal, and that a grounding area 112 is differentiated. When a plurality of wires of the electrical connecting member 130A and the electrical connecting member 130B are disposed in the receiving area R1 and the receiving area R2, the at least one grounding portion of the electrical connecting member 130A and the at least one grounding portion of the electrical connecting member 130B (a grounding portion 131 and a grounding portion 132 are illustrated herein as an example) are soldered to the grounding area 112 of the body 110, such that the electrical connecting member 130A and the electrical connecting member 130B are grounded.

In view of the foregoing, in the embodiments of the invention, the receiving area is disposed on at least one of the top portion and the bottom portion of the exterior of the body in the electric connector. When the electrical connecting member is electrically connected between the electronic device and the terminals of the electric connector, one end of the electrical connecting member is located in the receiving area and is electrically connected to the terminals, and another end of the electrical connecting member extends out of the receiving area along the second axis. The external electric connector is butted to the body of the electric connector along the first axis, and the first axis is different from the second axis.

Further, since the input module is disposed at the rear side of the electric connector, in order to allow the thickness of the casing of the electronic device to be maintained to be thin, the electrical connecting member can no longer be accordingly disposed in the space of the rear side of the electric connector because the space is occupied by the input module. A wiring direction of the electrical connecting member on the body of the electric connector is thus changed, and that the dimension of the electric connector along the first axis is effectively reduced. In this way, the space occupied by the electric connector in the electronic device is reduced, and therefore, applications of the electric connector are further expanded.

It will be apparent to those skilled in the art that various modifications and variations can be made to the disclosed embodiments without departing from the scope or spirit of the disclosure. In view of the foregoing, it is intended that the disclosure covers modifications and variations provided that they fall within the scope of the following claims and their equivalents.

What is claimed is:

1. An electric connector, suited for an electronic device, the electric connector comprising:

a body, suited for being disposed in the electronic device, the body having at least one receiving area, the receiving area being located on at least one of a top portion and a bottom portion of an exterior of the body;

a plurality of terminals, disposed in the body, an external electric connector suited for being butted to the body along a first axis to be electrically connected to the terminals;

an electrical connecting member, one end of the electrical connecting member being located in the receiving area to be electrically connected to the terminals, another end of the electrical connecting member extending out of the receiving area along a second axis to be electrically connected to the electronic device, wherein the first axis is different from the second axis;

a shielding member, assembled to the body to shield electromagnetic noise generated by the terminals or the electrical connecting member, wherein the body has a front side and a rear side opposite to each other, the external electric connector is butted to the body from the front side, the shielding member is located at the rear side, and the front side, the receiving area, and the rear side are arranged along the first axis.

2. The electric connector as claimed in claim 1, wherein the electronic device has an input module, and a portion of the input module is located at the rear side and is adjacent to the shielding member.

3. The electric connector as claimed in claim 1, wherein a portion of the shielding member extends from the rear side to the top portion or the bottom portion of the body to be electrically connected to at least one grounding portion of the electrical connecting member.

4. The electric connector as claimed in claim 1, wherein the shielding member has at least one punched-up protrusion, and the punched-up protrusion is electrically propped against at least one grounding portion of the electrical connecting member.

5. The electric connector as claimed in claim 1, wherein the first axis is orthogonal to the second axis.

6. An electric connector, suited for an electronic device, the electric connector comprising:

a body, suited for being disposed in the electronic device, the body having at least one receiving area, the receiving area being located on at least one of a top portion and a bottom portion of an exterior of the body;

a plurality of terminals, disposed in the body, an external electric connector suited for being butted to the body along a first axis to be electrically connected to the terminals;

an electrical connecting member, one end of the electrical connecting member being located in the receiving area to be electrically connected to the terminals, another end of the electrical connecting member extending out of the receiving area along a second axis to be electrically connected to the electronic device, wherein the first axis is different from the second axis; and a shielding member, assembled to the body to shield electromagnetic noise generated by the terminals or the electrical connecting member, wherein the terminals and the electrical connecting member are located at a same side of the shielding member.

7. An electric connector, suited for an electronic device, the electric connector comprising:

a body, suited for being disposed in the electronic device, the body having at least one receiving area, the receiving area being located on at least one of a top portion and a bottom portion of an exterior of the body;

a plurality of terminals, disposed in the body, an external electric connector suited for being butted to the body along a first axis to be electrically connected to the terminals; and an electrical connecting member, one end of the electrical connecting member being located in the receiving area to be electrically connected to the terminals, another end of the electrical connecting member extending out of the receiving area along a second axis to be electrically connected to the electronic device, wherein the first axis is different from the second axis, wherein the terminals are arranged along the second axis and extend along the first axis, the electrical connecting member has a first segment and a second segment, the first segment extends along the first axis to be electrically connected to the terminals, and the second segment extends along the second axis from the first segment to move out of the receiving area.

8. An electric connector, suited for an electronic device, the electric connector comprising:

a body, suited for being disposed in the electronic device, the body having at least one receiving area, the receiving area being located on at least one of a top portion and a bottom portion of an exterior of the body;

a plurality of terminals, disposed in the body, an external electric connector suited for being butted to the body along a first axis to be electrically connected to the terminals; and an electrical connecting member, one end of the electrical connecting member being located in the receiving area to be electrically connected to the terminals, another end of the electrical connecting member extending out of the receiving area along a second axis to be electrically connected to the electronic device, wherein the first axis is different from the second axis, wherein the body has a grounding area, and at least one grounding portion of the electrical connecting member is soldered to the grounding area.

* * * * *